US006991436B2

(12) United States Patent
Beckman et al.

(10) Patent No.: US 6,991,436 B2
(45) Date of Patent: Jan. 31, 2006

(54) AIR COMPRESSOR MOUNTED ON A COMPRESSOR TANK

(75) Inventors: Kurt Beckman, Springfield, MN (US); Andrew Kopel, Stanchfield, MN (US); Paul Klimek, New Ulm, MN (US); Jan Davidson, Springfield, MN (US)

(73) Assignee: Powermate Corporation, Aurora, IL (US)

( * ) Notice: Subject to any disclaimer, the term of this patent is extended or adjusted under 35 U.S.C. 154(b) by 66 days.

(21) Appl. No.: 10/207,448

(22) Filed: Jul. 29, 2002

(65) Prior Publication Data

US 2004/0018098 A1 Jan. 29, 2004

(51) Int. Cl.
*F04B 23/14* (2006.01)

(52) U.S. Cl. ..... 417/201; 417/312; 417/234; 417/415; 417/368

(58) Field of Classification Search ..... 137/377, 137/382, 565.18; 417/234, 415, 362, 310, 417/368, 201, 312; 310/62, 63; 181/403, 181/199.1

See application file for complete search history.

(56) References Cited

U.S. PATENT DOCUMENTS

| | | | | | |
|---|---|---|---|---|---|
| 1,187,031 | A | | 6/1916 | Black et al. | |
| 2,279,620 | A | | 4/1942 | Hirschman | |
| 2,283,025 | A | | 5/1942 | Wolfert | |
| 3,255,779 | A | | 6/1966 | Russell | |
| 4,341,506 | A | * | 7/1982 | Klein | 417/362 |
| 4,348,604 | A | * | 9/1982 | Thode | 310/62 |
| 4,492,533 | A | | 1/1985 | Tsuge | |
| 4,527,387 | A | | 7/1985 | Lastrina et al. | |
| 4,527,960 | A | | 7/1985 | DeSisto | |
| 4,529,365 | A | | 7/1985 | Schutt et al. | |
| 4,869,641 | A | | 9/1989 | Hufgard | |
| 5,007,450 | A | * | 4/1991 | Babb et al. | 174/145 |
| 5,055,010 | A | | 10/1991 | Logan | |
| 5,077,450 | A | * | 12/1991 | Rafiee | 174/145 |
| 5,137,434 | A | | 8/1992 | Wheeler et al. | |
| 5,199,858 | A | * | 4/1993 | Tsuboi et al. | 417/362 |
| 5,203,679 | A | * | 4/1993 | Yun et al. | 417/312 |
| 5,378,119 | A | * | 1/1995 | Goertzen | 417/313 |
| 5,555,764 | A | * | 9/1996 | Dybas | 73/296 |
| 6,011,331 | A | * | 1/2000 | Gierer et al. | 310/58 |
| 6,375,437 | B1 | * | 4/2002 | Nolan | 417/234 |
| 6,431,194 | B1 | * | 8/2002 | Hardin et al. | 137/1 |
| 6,431,839 | B2 | * | 8/2002 | Gruber et al. | 417/234 |
| 6,579,071 | B1 | * | 6/2003 | Tarutani et al. | 417/269 |
| 2003/0235507 | A1 | * | 12/2003 | Kwang-Tsan | 417/312 |

FOREIGN PATENT DOCUMENTS

| | | | |
|---|---|---|---|
| EP | 0 050 770 A1 | | 5/1982 |
| JP | 356060884 A | * | 5/1981 |

* cited by examiner

*Primary Examiner*—Cheryl Tyler
*Assistant Examiner*—Emmanuel Sayoc
(74) *Attorney, Agent, or Firm*—Leydig, Voit & Mayer, Ltd.

(57) ABSTRACT

An air compressor having a cooling fan that cools both a pump and an electric motor. Baffle compress air against the top of the motor, causing it to break up and flow around fours sides of the motor and through the motor. The pump includes an elongate intake tube or muffler that attenuates pump intake noise. A compressor tank for the air compressor includes a roll cage for protecting a condensate valve for the compressor tank. The compressor tank includes a rim base formed on the bottom of the compressor tank that permits the compressor tank to rest on a surface without additional supports or legs. Controls and gauges are mounted in the bottom clamshell piece, and openings on a top fit around the controls and gauges. The top and the bottom are aligned with guides so that the controls and gauges may be properly aligned with the openings.

3 Claims, 4 Drawing Sheets

AIR COMPRESSOR MOUNTED ON A COMPRESSOR TANK

FIELD OF THE INVENTION

The present invention relates generally to power tools, and more particularly to air compressors.

BACKGROUND OF THE INVENTION

Air compressors are becoming commonplace in home workshops. In general, an air compressor, or an air pump, is a machine that decreases the volume and increases the pressure of a quantity of air by mechanical means. Air thus compressed possesses great potential energy, because when the external pressure is removed, the air expands rapidly. The controlled expansive force of compressed air is used in many ways and provides the motive force for air motors and tools, including pneumatic hammers, air drills, sandblasting machines, and paint sprayers.

A conventional home workshop air compressor includes a storage tank for compressed air, and a prime mover mounted on the compressor tank for compressing the air flowing into the compressor tank. The prime mover may be a gas engine or an electric motor, but most conventional home workshop models utilize electric power. The compressor tanks are typically steel and cylindrical in shape, and sizes vary greatly, but typically, home workshop models range between four and thirty gallons. An air compressor typically includes a pedestal of some kind (e.g., four feet) that allows the compressor to rest on a surface such as a floor. Alternatively, for some larger models, a pair of wheels may be provided on one end of the compressor tank and a handle on the other end, permitting the air compressor to be wheeled around a work shop, for example.

In an air compressor, ambient air, which includes atmospheric humidity (i.e., water vapor), is drawn into the compressed air system where it is compressed to a desired discharge pressure. During the compression process, the water vapor is heated, and while stored in the compressor tank, the air and water vapor cool. Moisture, in the form of condensation, drops out of the airflow as it cools. This condensation accumulates in the bottom of the compressor tank, forming a liquid called a condensate.

Most home workshop air compressors include a drain at a lower portion of the compressor tank to drain condensate out of the compressor tank. The drain is typically a valve that extends into the compressor tank for the air compressor, and out beyond the sidewalls of the compressor tank.

Generally, an oilless air compressor (also termed an "air pump") is an air compressor that utilizes a piston that does not require lubrication. One configuration of an oilless air compressor includes an electric motor rotating an eccentric which, in turn, causes a piston to reciprocate up and down within a cylinder. The eccentric translates the rotary motion of the motor into a reciprocating motion for the piston. On a piston down-stroke, air is pulled into the cylinder and on a piston up-stroke, air is compressed and forced out of the cylinder.

Air drawn into the cylinder of an oilless air compressor flows through one-way valves that permit the air to flow into the cylinder, but not flow out of the cylinder as the cylinder returns along an up-stroke. This air intake is often noisy, so many prior art air compressors include short pump head air intake mufflers. Although these air intake mufflers work well for their intended purpose, there is still quite a bit of noise from the intake valves that is audible to people in the air compressor's immediate surroundings.

The term "oilless" used to describe an air pump refers to the fact that a seal that wraps around the piston for the air pump and extends between the piston and the cylinder of the air pump is sufficiently resilient that it does not require oil to slide within the cylinder. The life of the seal is determined by the number of strokes, and the operating temperature to which the seal is subjected. To keep the operating temperature low, conventional air pumps often include cooling fans that direct a flow of ambient air over the cylinder, valve plate, and head.

The cylinder, valve plate, and head for an air pump are not the only parts that need to be cooled. The electric motor for an air pump also needs to be cooled. In addition, because the electric motor often rotates too fast to directly drive a piston, a drive belt is included that reduces the speed of rotation and provides a link between the electric motor and the piston. Because the operational life of this belt is determined by motor speed, motor torque, and belt temperature, the belt also needs to be cooled.

Most contemporary belt drive oilless air compressors utilize two separate fans: one for cooling the electric motor and its components, and the other for cooling the cylinder. An exception is the oilless air compressors disclosed in U.S. Pat. No. 5,137,434 to Wheeler, et al. Wheeler discloses an air compressor having a single fan mounted at one end of an air pump shroud that houses both the cylinder and the motor. Baffles are provided in the shroud to separate the air flow from the fan blades into first, second and third air flows. The first air flow passes sequentially over the motor commutator/brushes, between the rotors and stator and over the exterior walls of the cylinder. The second air flow is directed over the cylinder-head assembly, and the third air flow is directed over the drive belt. According to Wheeler, by splitting the air into different flow paths, the drive belt and the cylinder-head assembly are not subjected to heat from the motor.

SUMMARY OF THE INVENTION

The present invention is directed to an oilless air compressor having a high speed electric motor that drives an air compressor pump. The electric motor and the air compressor pump are mounted on a common frame with a pulley gear reduction system between the two. A single shroud is mounted around the motor and the pump. The shroud is a clamshell configuration having top and bottom halves. The top includes multiple openings for controls and gauges for the air compressor. The controls and gauges are mounted in the bottom of the shroud and alignment guides are used in the top to properly position the top relative to the bottom so that the two clamshell halves are fitted together and the openings are precisely aligned with the gauges and controls. By mounting the controls and gauges on the shroud, proper alignment of the controls and gauges is provided.

A fan is mounted to rotate with the motor. The fan draws air into the shroud via an intake vent, and the baffling and the configuration of the common mount causes the cooling path from the fan to be compressed against the motor, causing it to break up into five cooling paths. These five cooling paths flow over, under, behind, in front of, and through the motor, respectively. Some flow over the drive belt for the pulley gear reduction system. The five paths flow over the pump and exit out of a common exhaust vent. As such, the five paths of air flow provide cooling of the pump and the motor.

In accordance with one aspect of the present invention, the air compressor includes an intake tube on the cylinder for the pump. The intake tube is preferably directed down, away from the user. Directing the sound away from the user results in quieter sound levels at the user's vantage point.

The air compressor also includes a condensate valve roll cage that protects the condensate valve on the air compressor tank. The condensate roll cage may be incorporated into a support leg for the compressor tank, or may be mounted directly on the compressor tank.

In accordance with another aspect of the present invention, a compressor tank for the air compressor may include a rim base incorporated into the bottom of the compressor tank. The rim base may be formed integral with the bottom of the air compressor tank and may be situated so that an air compressor may rest thereon. In this manner, the air compressor does not require additional support legs or support wheels to support the air compressor during use or storage.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention. In addition, to the extent that orientations of the invention are described, such as "top," "bottom," "front," "rear," and the like, the orientations are to aid the reader in understanding the invention, and are not meant to be limiting.

Figure 1:
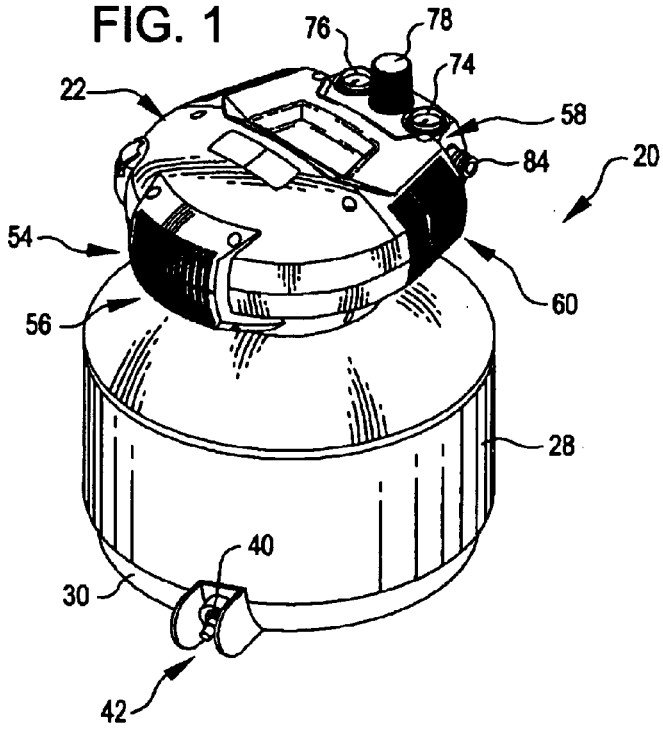
FIG. 1 is a side perspective view of an air compressor embodying the present invention.

Referring now to the drawings, in which like reference numerals represent like parts throughout the several views, FIG. 1 shows an air compressor 20 embodying the present invention. Briefly described, the air compressor 20 provides at least five novel aspects. First, a pump and motor shroud 22 is designed so that a single cooling fan 122 (FIG. 4) may cool both a pump 24 and an electric motor 26 for the air compressor 20. Second, the pump 24 includes an elongate intake tube or muffler 150 (FIG. 5) that attenuates pump intake noise and directs it away from the user. Third, a compressor tank 28 for the air compressor 20 includes a roll cage 42 (best shown in FIG. 2) for protecting a condensate valve 40 for the compressor tank 28. Fourth, the compressor tank 28 includes a rim base 30 formed on the bottom of the compressor tank 28 that permits the compressor tank 28 to rest on a surface without additional supports or legs. Fifth, the pump and motor shroud 22 for the air compressor 20 includes mounting locations in a bottom clamshell piece for receiving controls and gauges, and openings on a top for the shroud for fitting around the controls and gauges. The top and the bottom are aligned with guides so that the controls and gauges may be properly aligned with the openings.

The pump 24 and the electric motor 26 constitute the prime mover for the air compressor 20. Although some features of the present invention are directed to a prime mover that utilizes an electric motor 24, other features may be incorporated in an air compressor having a gasoline engine and a pump. If an electric motor is used, a power cord (not shown, but known in the art) is provided for connecting the electric motor 26 to a power source. The operation and function of prime movers for air compressors are known and not described in detail here.

The compressor tank 28 for the air compressor 20 is, for example, a four-gallon cylindrical compressor tank. The compressor tank shown in the drawings is oriented in an upright, vertical position. However, the aspects of the present invention may be utilized for an air compressor having a compressor tank that is aligned horizontally or in other directions. Moreover, the shape of the compressor tank is not critical, and may be cylindrical, or may have one of many other profiles.

Figure 2:
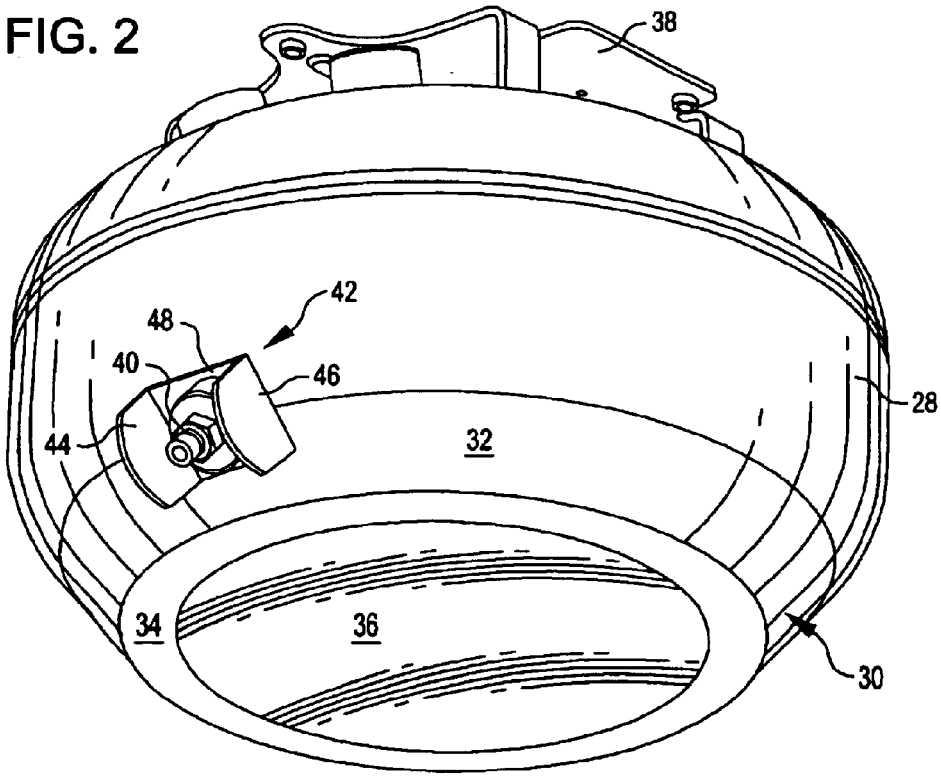
FIG. 2 is a bottom side perspective view of a compressor tank for the air compressor of FIG. 1.

The rim base 30 is shown in detail in FIG. 2. The rim base 30 extends around a lower edge of the compressor tank 24, and includes an outer, rolled edge 32. The outer, rolled edge 32 terminates at a flat bottom outer ring 34. A concave bottom 36 is spaced in from the flat bottom outer ring 34. The sloped sides of the outer, rolled edge 32 and the concave bottom 36 cause the compressor tank 28 to rest on the flat bottom outer ring 34 when the air compressor 20 is placed on the ground without other supports.

The rim base 30 may be formed, for example, of a metal that is similar to or the same as the metal for the compressor tank 28. The rim base 30 may be formed integral with the compressor tank 28, or may be attached thereto, for example by welding, an adhesive, fasteners, or by other suitable means. The rim base 30 may be additional material added to compressor tank 28, or the compressor tank 28 may extend into the area defined by the rim base 30. If the compressor tank 28 extends into this area, the rim base 30 is preferably reinforced to prevent denting of the compressor tank 28 when placed on the rim base 30.

If desired, a separate pedestal (not shown) may be provided, into which the bottom edge of the compressor tank 28 and the rim base 30 may rest. The pedestal may include legs, wheels, or other suitable supports for permitting the air compressor 20 to rest upon the pedestal.

A platform 38 is attached to the top of the compressor tank 28. The shroud 22, the pump 24, and the electric motor 26 are mounted on the platform 38.

The roll cage 42 is shown in detail in FIG. 2, and can also be seen in FIG. 1. The roll cage 42 is designed to protect a condensate valve 40, which may, for example, be a standard exhaust valve with a release mechanism such as a stem that may be pulled or pushed to release air and/or condensate out of the compressor tank 28. In the embodiment shown, the roll cage 42 includes a pair of flanges 44, 46 extending out of a base plate 48. The base plate 48 extends parallel to and against the side of the compressor tank 28, and the flanges 44, 46 bend outward from the base plate 48, for example perpendicular to the base plate 48. In the embodiment shown, the flanges 44, 46 includes rounded outer edges that prevent snags with adjacent articles, but still protect the condensate valve 40 from being damaged when the air compressor 20 is moved or is rolled up on one side. To this end, when the air compressor 20 comes into contact with a foreign object or is rolled up on to its side, the flanges 44, 46 extend beyond the distal end of the condensate valve 40 so that the foreign object comes into contact with the flanges instead of the condensate valve 40.

The roll cage 40 is preferably rigid in construction so that it does not easily bend or break when it comes into contact with walls or other objects. As example, the roll cage 40 may be formed of steel. Steel, aluminum, or other suitable materials may be used for the roll cage 40, and the roll cage may be welded, adhered, or otherwise suitably fastened to the compressor tank 24.

Figure 3:
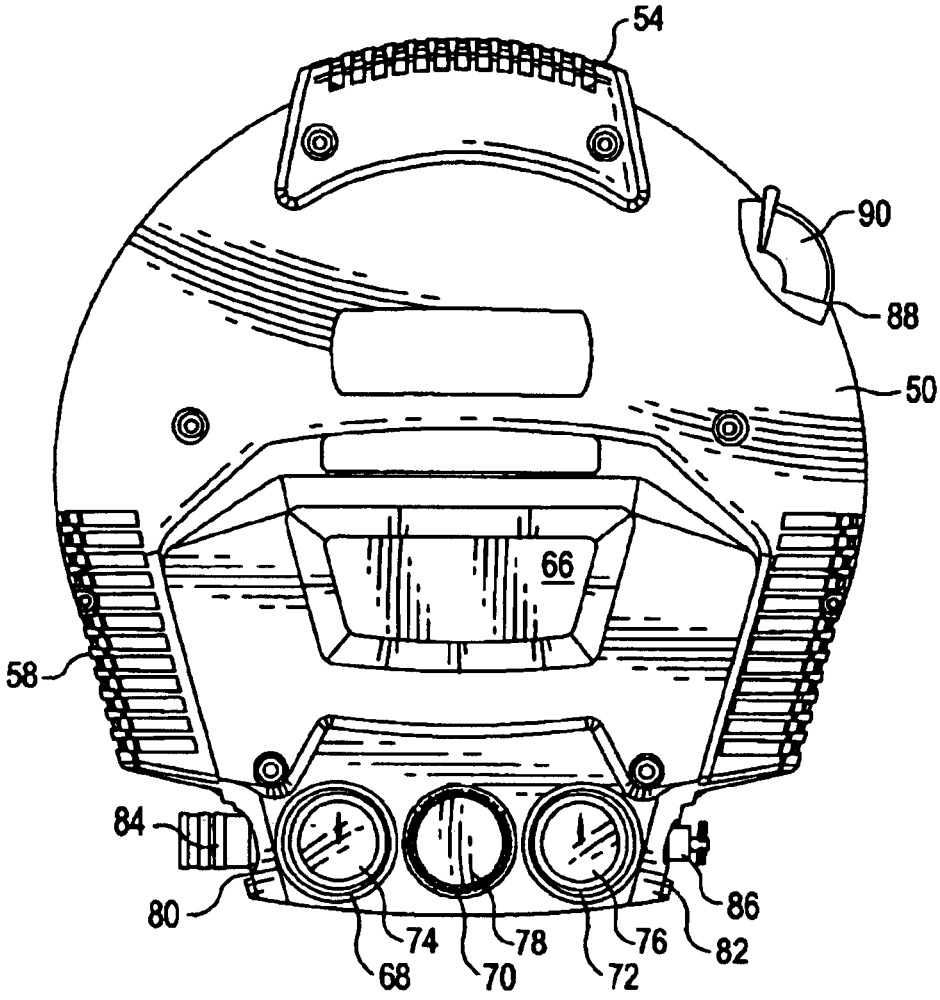
FIG. 3 is a top view of the air compressor of FIG. 1, showing a top portion of an air pump shroud for the air compressor.
Figure 4:
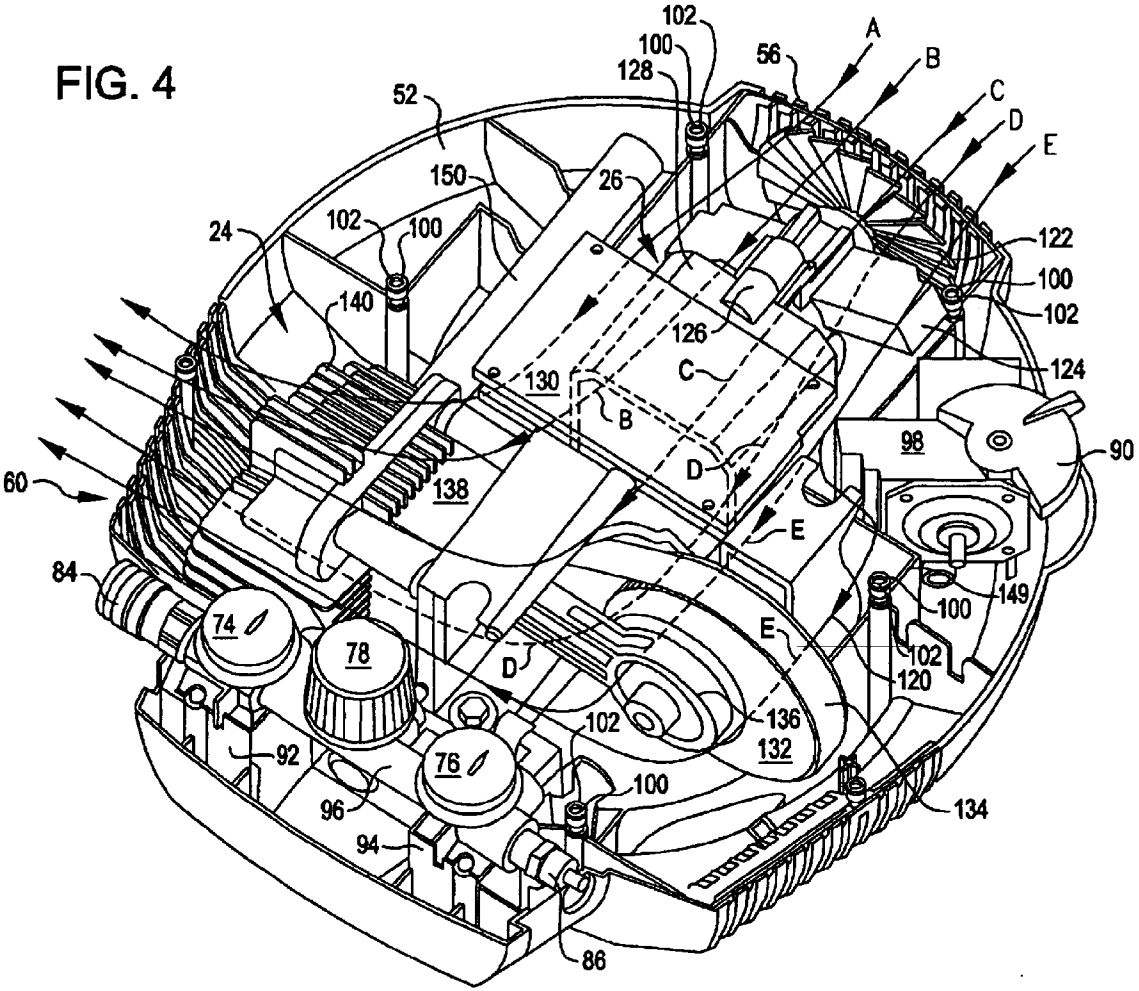
FIG. 4 is a side perspective view of a bottom portion of the air pump shroud of the air compressor of FIG. 1, showing a motor and pump assembly for the air compressor.

A top 50 and a bottom 52 for the pump and motor shroud 22 are shown in FIGS. 3 and 4. The top 50 and the bottom 52 form a clamshell-type enclosure for enshrouding the pump 24 and the electric motor 26. The top 50 and bottom 52 include an upper vent portion 54 and a lower vent portion 56 that fit together to form a single vent when the top 50 and bottom 52 are attached. Likewise, a left side vent is formed by upper and lower side vent portions 58, 60.

The top 50 of the pump and motor shroud 22 includes a recess 66 in a central portion for receiving tools. A series of holes 68, 70, 72 extend upward through a front, top portion of the top 50 and are configured and arranged to receive gauges 74, 76 and a regulator knob 78 that are attached to the bottom 52. In addition, indentations 80, 82 are provided on opposite front side edges of the top 50 for fitting over an air outlet connector valve 84 and a relief valve 86, respectively. These two valves 84, 86 are also mounted in the bottom 52. An opening 88 is also provided in the top 50 of the pump and motor shroud 22 for receiving an on/off switch 90 that is also mounted in the bottom 52.

Turning now to FIG. 4, the bottom 52 includes integral mounting locations 92, 94 that receive a manifold 96 (FIG. 4) for the gauges 74, 76, the regulator knob 78, the air outlet connector valve 84, and the relief valve 86. The manifold 96 is connected to each of these locations 92, 94 prior to assembly of the top 50 and the bottom 52. A mounting post 98 is also provided for the on/off switch 90. This mounting post 98 and the integral mounting locations 92, 94 may all be formed integral with the bottom 52. If the bottom is formed out of plastic, the mounting locations may be closely toleranced so that the air outlet connector valve 84, the relief valve 86, the on/off switch 90, the gauges 74, 76, and the regulator knob 78 are properly positioned when connected to the bottom 52.

The bottom also includes a series of mounting pins 100 (five of six are shown in FIG. 4, but any number may be used) mounted around its periphery. The mounting pins include external cylinders 102 that extend upward from the bottom 52.

When the top 50 is placed over the bottom 52, caps (not shown) on the bottom of the top 50 fit around the external cylinders 102 on the mounting pins 100. The caps and the cylinders 102 act as mounting guides for properly aligning the top 50 with the bottom 52, and prevent improper alignment of the openings in the top with the air outlet connector valve 84 and a check valve 86, the on/off switch 90, and the gauges 74, 76 and the regulator knob 78. In this manner, the controls and gauges for the air compressor 20 may be tightly fit against the top 50, giving the outside of the compressor a sleek, finished appearance such as is shown in FIG. 3.

Figure 5:
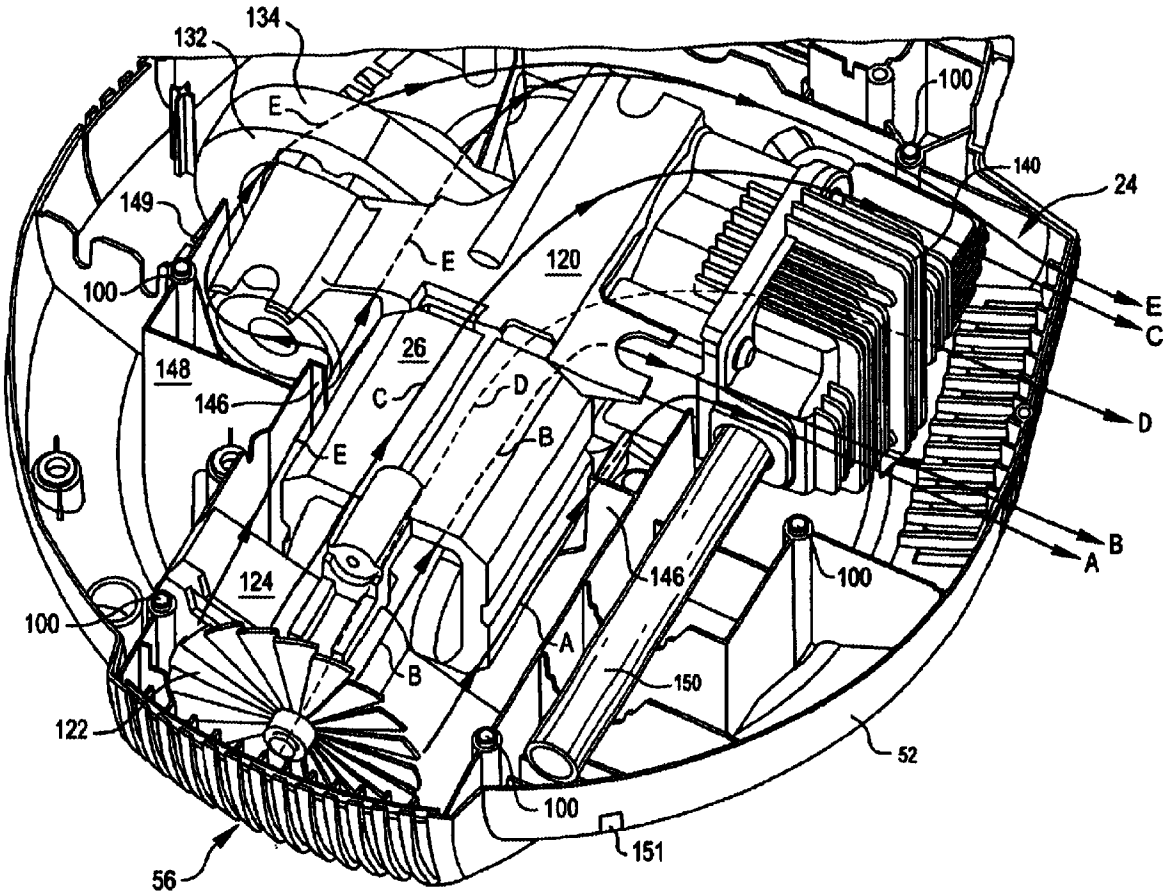
FIG. 5 is a partial cut-away view showing a rear side of the bottom part of the shroud in FIG. 4, and displaying an air intake tube for the pump in accordance with one aspect of the present invention.

The layout of the pump 24 and the electric motor 26 in the bottom 52 of the pump and motor shroud 22 can best be seen in FIGS. 4 and 5. The electric motor 26 is centrally located in the bottom 52 of the pump and motor shroud 22 and is attached to a common mounting frame 120 that extends through the middle of the bottom 52. The fan 122 is mounted on the electric motor 26 between the rear vent portions 54, 56 of the pump and motor shroud 22 and brushes 124 for the electric motor 26. The brushes 124 are mounted on the rotor 126 for the electric motor 26, which, in turn, is mounted in the stator 128. A plate 130 is mounted over the top of the electric motor 26 for heat dissipation and air flow, as further described below.

The electric motor 26 uses gear reducing pulleys to transmit high speed, low torque motor energy into low speed, high torque pump energy. Only one driven pulley 132 is shown in the drawings, but a two-pulley gear reduction or even more pulleys may be used. A drive belt 134 extends around the driven pulley 132 and is attached for rotation with the rotor 126.

A piston 136 is eccentrically mounted on the driven pulley 132 so that rotation of the driven pulley 132 causes the piston 136 to move back and forth. The piston 136 is mounted in a cylinder 138 having a pump head 140. The pump head 140 is located adjacent to the side vent portions 58, 60 in the top 50 and bottom 52 of the pump and motor shroud 22.

The structure and operation of an electric motor (such as the electric motor 26) and a pump (such as the pump 24) is known in the art and is not described here. However, the location and arrangement of the electric motor 26 and the pump 24 relative to the pump and motor shroud 22 provides a novel cooling arrangement for the pump 24 and the electric motor 26. Specifically, the configuration of the motor shroud and the locations of the fan 122, the electric motor 26, and the pump 24 permit cooling air to enter the rear vent portions 54, 56 (hereinafter "inlet vents"), divide into five paths, and then rejoin to exhaust through the left side vent portions 58, 60 (hereinafter "exhaust vents"). On the five paths, the electric motor 26, the drive belt 134, and the pump head 140 are cooled.

The five cooling paths are shown by the letters A–E in FIG. 4. A first cooling path A flows over the brushes 124 for the electric motor 26, flows around the left side of the stator 128, flows over the cylinder 138, and turns ninety degrees to flow over the pump head 140 and out of the exhaust vents. This flow path is essentially around the front of the electric motor 26 and then over the pump 24. A second cooling path B flows over the brushes 128, through the electric motor 26 between the rotor 126 and the stator 128, over the drive belt 134, turns ninety degrees and flows over the pump head 140 and out of the exhaust vents. This second path B thus runs through the electric motor 26 and over the pump 24. The third and fourth cooling paths C and D flow over the brushes 124 and over (path C) or under (path D) the stator 128, past the belt 134, turn ninety degrees and flow over the pump head 140 and out through the exhaust vents. The fifth cooling path E flows over the brushes 124, around the outside (i.e., the right side in FIG. 4) of the stator 128, around the bottom of the common mounting frame 120, through the driven pulley 132, and turns ninety degrees and flows over the pump head 140 and out through the exhaust vents.

The centrally mounted location of the electric motor 26 and the rounded shape of the pump and motor shroud 22 permits air flowing from the fan 122 to flow into and around all four sides of the electric motor 26. In addition, the motor shroud is configured so that air is compressed as it leaves the fan 122 and forced against the top of the electric motor 26. As such the air disperses and flows through and around the sides of the motor.

The baffle structure that is used to compress the air exiting the fan 122 can be seen in FIGS. 4 and 5. In summary, the air leaving the fan 122 flows through a corridor that decreases in cross section before it reaches the electric motor 26. This decrease in cross section causes the air flow to increase in pressure and turbulence, increasing the likelihood that the air flow will break up as it hits the electric motor 26 and will flow around the electric motor as well as through it. In the embodiment shown in the drawings, this reduced diameter is produced by walls 146 (FIG. 5) on the bottom 52 and similar walls (not shown) on the top. These walls 146 narrow the passageway for the flow of air, and assure that the air flowing around the sides of the electric motor 26 flow adjacent to the motor, assuring better cooling.

The motor is centered in the passageway between the walls 146. The only escapes for air flow are through the motor or around its sides. Air flowing behind the motor (path E, FIG. 5) is further directed by walls 148, 149 into contact with the belt 134 and the driven pulley 132.

The five different paths for air flow from the fan 122 are the four sides of the electric motor 26, and flow through the electric motor 26. The four sides are described for illustrative purposes, and boundaries do not exist, for the air flow may flow at corners and not necessarily at all locations around the sides. These air flows are directed over the pump head 140 as they exit through the exhaust vents. Because the air flow is from different directions after coming over the electric motor 26, the air flows exit at different locations on the pump head 140 and provide even air flow over the pump head 140. Thus, the flow from the single fan 122 provides air flow over the electric motor 26 and the pump 24 providing cooling for both. The cooling of the electric motor 26 assures that it will not overheat during operation, and the cooling of the pump head 140 and the cylinder 138 assures that the seal for the piston 136 will not be overheated, and thus prolongs the life of the seal. In addition, the air flows through the drive belt 134 keeping the drive belt 134 cool and prolonging its life.

As is known, in typical operation of a pump (e.g., the pump 24), during a piston down-stroke, air enters the pump 24 via an intake. The air flows into an intake chamber in the pump head 140, through a valve plate for the pump 24, and into the cylinder 138. During an up-stroke of the piston 136, the piston 136 pushes air out of the cylinder 138, through the valve plate and exhausts out of the valve plate outlet.

In accordance with the present invention, a novel, intake tube or muffler 150 is used to attenuate the noise associated with air flowing into the pump head 140. The intake tube 150 is attached to the air intake of the pump head 140. The air intake is in fluid communication with the intake valve, and air must flow through the intake tube 150 to flow into the intake valve. In accordance with the present invention, the inlet of the intake tube 150 is positioned in a portion of the motor shroud 22 in which there are no upper openings, e.g., there is only one opening 151 and it is located on the lower side of the motor shroud 22. As such, the noise associated with air flowing into the pump head 140 is directed away from a user, resulting in quieter sound levels from the user's viewpoint.

Applicants have found that using an intake tube or muffler 150 that is five inches or longer aids in lowering the tone of the noise from the intake tube, further diminishing the noise heard by a user. Longer lengths make the noise even lower in pitch, and preferably the intake tube or muffler 150 is at least seven inches in length. The intake tube or muffler 150 may be formed of any suitable material, but in one embodiment is made of rigid polyvinylchloride ("PVC").

Other variations are within the spirit of the present invention. Thus, while the invention is susceptible to various modifications and alternative constructions, a certain illustrated embodiment thereof is shown in the drawing and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An air compressor, comprising:

a pump comprising a head, the head having an intake port;

a shroud surrounding the pump and having an air intake opening on a lower side; and an intake tube attached to the intake port and positioned so that an inlet portion of the intake tube is adjacent to the air intake opening, wherein air flowing into the pump head via the intake tube is directed through the air intake opening and away from an upper portion of the shroud.

2. The air compressor of claim 1, wherein the intake tube is at least approximately 7 inches in length.

3. The air compressor of claim 1, wherein a top side of the shroud is devoid of openings adjacent the inlet of the intake tube.

* * * * *